US006561140B2

(12) United States Patent
Nagashima

(10) Patent No.: US 6,561,140 B2
(45) Date of Patent: May 13, 2003

(54) WATER COOLING SYSTEM FOR ENGINE

(75) Inventor: Mitsuru Nagashima, Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 22 days.

(21) Appl. No.: 09/952,857

(22) Filed: Sep. 13, 2001

(65) Prior Publication Data

US 2002/0108587 A1 Aug. 15, 2002

(30) Foreign Application Priority Data

Sep. 13, 2000 (JP) ..... 2000-278647

(51) Int. Cl.[7] ..... F01P 7/14
(52) U.S. Cl. ..... 123/41.08; 440/89
(58) Field of Search ..... 123/41.08; 440/88, 440/89, 900

(56) References Cited

U.S. PATENT DOCUMENTS

| | | | |
|---|---|---|---|
| 4,399,797 | A | 8/1983 | Iwai |
| 4,452,194 | A | 6/1984 | Watanabe |
| 4,545,332 | A | 10/1985 | Suzuki et al. |
| 4,588,385 | A | 5/1986 | Suzuki et al. |
| 4,917,639 | A | 4/1990 | Onoue |
| 5,036,804 | A | 8/1991 | Shibata |
| 5,048,467 | A | 9/1991 | Kojima |
| 5,109,809 | A | 5/1992 | Fujimoto |
| 5,251,577 | A | 10/1993 | Kojima |
| 5,330,376 | A | 7/1994 | Okumura |
| 5,438,962 | A | 8/1995 | Iwata et al. |
| 5,537,958 | A | 7/1996 | Nishimura et al. |
| 5,555,855 | A | 9/1996 | Takahashi |
| 5,713,771 | A | 2/1998 | Takahashi et al. |
| 5,769,038 | A | 6/1998 | Takahashi et al. |
| 5,778,847 | A | 7/1998 | Takahashi et al. |
| 5,803,023 | A | 9/1998 | Takahashi et al. |
| 5,803,036 | A | 9/1998 | Takahashi et al. |
| 5,823,835 | A | 10/1998 | Takahashi et al. |
| 5,830,021 | A | 11/1998 | Takahashi et al. |
| 5,865,655 | A | 2/1999 | Hiraoka et al. |
| 5,873,330 | A | 2/1999 | Takahashi et al. |
| 5,876,256 | A | 3/1999 | Takahashi et al. |
| 5,921,829 | A | 7/1999 | Iwata |
| 5,941,205 | A | 8/1999 | Hiraoka et al. |
| 5,950,425 | A | 9/1999 | Takahashi et al. |
| 5,975,032 | A | 11/1999 | Iwata |
| 5,980,340 | A | 11/1999 | Okamoto |
| 6,053,784 | A | 4/2000 | Takahashi |
| 6,083,064 | A | 7/2000 | Watanabe et al. |
| 6,109,987 | A | 8/2000 | Watanabe et al. |

FOREIGN PATENT DOCUMENTS

| | | |
|---|---|---|
| JP | 10-24899 | 1/1998 |

*Primary Examiner*—Noah R. Kamen
(74) *Attorney, Agent, or Firm*—Knobbe, Martens, Olson & Bear LLP

(57) ABSTRACT

An outboard motor includes a housing unit adapted to be mounted on an associated watercraft. An engine is mounted on the housing unit. The housing unit defines a water delivery passage and a water discharge passage. Both the passages communicate with each other through a lower opening. The water delivery passage is arranged to deliver cooling water to the engine. The water discharge passage is arranged to discharge the cooling water from the engine. The discharge passage communicates with a location out of the housing unit through an upper opening. A pressure relief valve unit extends through the lower and upper openings. The pressure relief valve unit allows the cooling water in the delivery passage to move to the discharge passage when a pressure of the delivery passage becomes greater than a preset pressure.

27 Claims, 5 Drawing Sheets

WATER COOLING SYSTEM FOR ENGINE

This application is based on and claims priority to Japanese Patent Application No. 2000-278647, filed Sep. 13, 2000, the entire contents of which is hereby expressly incorporated by reference.

BACKGROUND OF THE INVENTION

1. Field of the Invention

The present invention relates generally to a water cooling system for an engine, and more particularly to an improved water cooling system that includes a pressure control valve.

2. Description of Related Art

During operation, typical internal combustion engines generate substantial heat and require that generated heat to be removed to avoid overheating. A number of cooling systems are available for that purpose. Typically, marine engines, such as, for example, outboard motors and inboard/outboard motors, employ an open-loop type water cooling system such that introduces cooling water from the body of water surrounding the motor and discharges the water to a location outside of the motor after the water absorbs some of the heat from the engine.

An outboard motor, in general, comprises a housing unit mounted on an associated watercraft by a bracket assembly and an engine mounted within the housing unit. The engine can employ an open-loop type water cooling system such as that described above. The housing unit normally defines a water supply passage and a water discharge passage. The water supply passage introduces cooling water from the body of water through a water inlet port disposed at a position that is submerged when a lower portion of the housing unit is disposed under the water. A water pump driven by the engine is used to pressurize the water for supply to the engine. The water discharge passage in turn discharges the water that has circulated within the engine from a water outlet port which usually is positioned at a submerged position. The discharge passage can be used to circulate the water to other components such as, for example, an exhaust conduit or an oil reservoir so that the water can absorb additional heat before being discharged.

The water cooling system can be provided with a pressure control valve to relieve the water pressure in the supply passage if the pressure becomes greater than a preset pressure. The pressure control valve generally is located at a portion of the supply passage and normally is connected to the water outlet port so that the excess water is discharged from the outlet port. Optionally, the excess water can merge with the water passing through the discharge passage in some arrangements. In this arrangement, the discharge passage usually is spaced apart from the supply passage and hence a relatively large pressure relief construction is necessary between the supply and discharge passages. This construction, however, is unsuitable for the outboard motors. Outboard motors are generally compactly constructed and, therefore, positioning such a connecting pathway within the housing unit of the motor is extremely difficult.

A need therefore exists for an improved water cooling system that can permit cooling water in a water supply passage to move to a water discharge passage with a compact pressure relief construction. The pressure relief construction can include a pressure control valve. The pressure control valve preferably can be easily mounted onto and/or dismounted from the housing unit for maintenance, inspection, replacement and the like.

SUMMARY OF THE INVENTION

In accordance with one aspect of the present invention, a water cooling system for an internal combustion engine comprises a housing body defining a water supply passage and a water discharge passage. The supply passage is arranged to introduce water into the system from outside. The discharge passage is arranged to discharge the water to a location outside of the system. The supply and discharge passages extend close to each other at least at one location. The housing body further defines an opening at the location through which the supply and discharge passages communicate with each other. A pressure control valve unit is disposed within the opening to connect or disconnect the supply passage with the discharge passage. The pressure control valve unit permits the water in the supply passage to move to the discharge passage when a pressure of the supply passage is greater than a preset pressure.

In accordance with another aspect of the present invention, an outboard motor comprises a housing unit adapted to be mounted on an associated watercraft. An internal combustion engine is mounted on the housing unit. The housing unit defines a water delivery passage and a water discharge passage communicating with each other through a first opening. The water delivery passage is arranged to deliver cooling water to the engine. The water discharge passage is arranged to discharge the cooling water from the engine. The delivery passage or the discharge passage communicate with a location out of the housing unit through a second opening. A pressure relief valve assembly extends through the first and second openings. The pressure relief valve assembly is arranged to allow the cooling water in the delivery passage to move to the discharge passage when a pressure of the delivery passage is greater than a preset pressure.

BRIEF DESCRIPTION OF THE DRAWINGS

These and other features, aspects and advantages of the present invention will now be described with reference to the drawings of a preferred embodiment, which embodiment is intended to illustrate and not to limit the present invention. The drawings comprise five figures.

DETAILED DESCRIPTION OF THE PREFERRED EMBODIMENT OF THE PRESENT INVENTION

Figure 1:
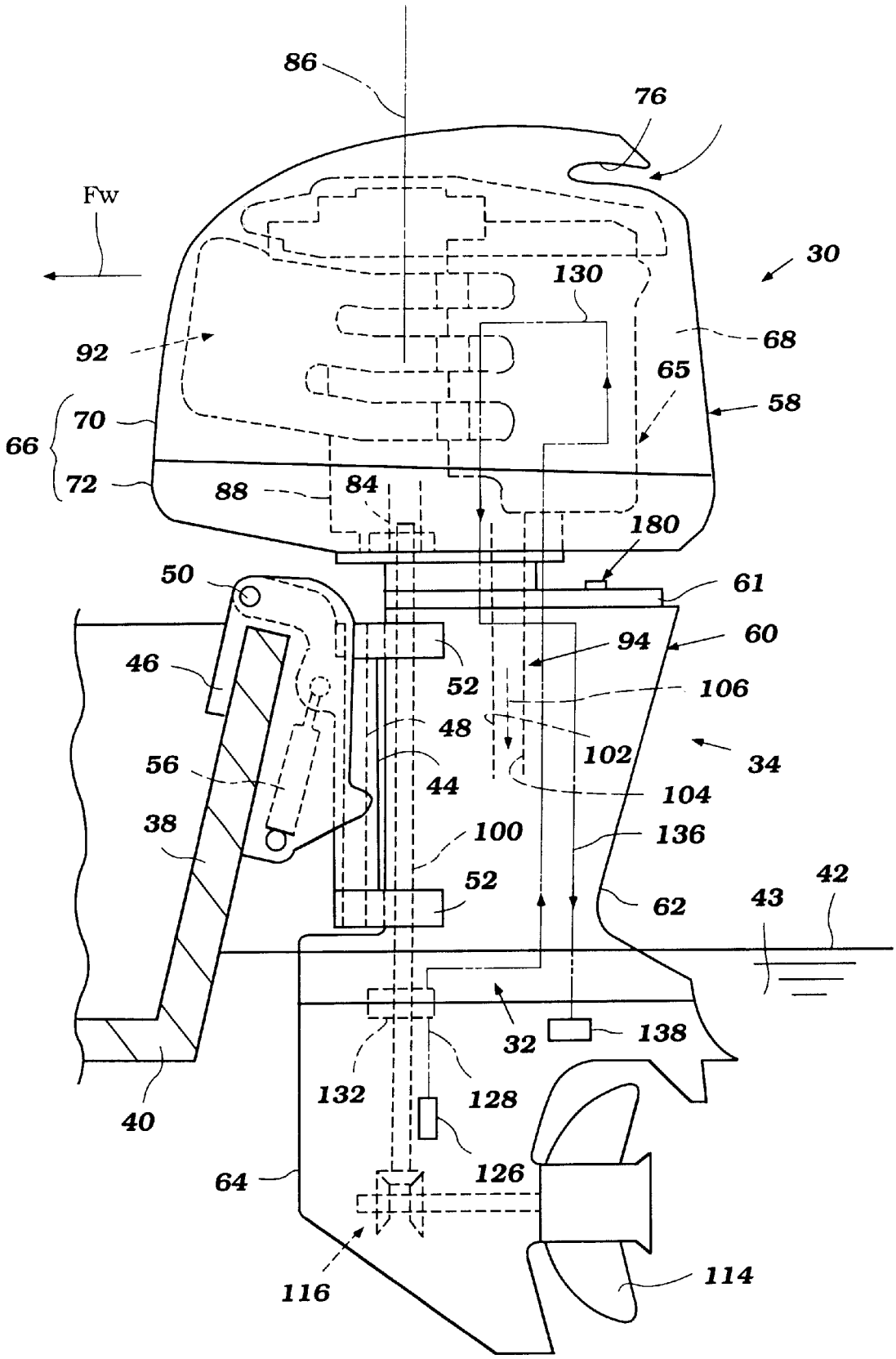
FIG. 1 is a side elevation view of an outboard motor configured in accordance with a preferred embodiment of the present invention. A portion of an associated watercraft is shown in section.
Figure 2:
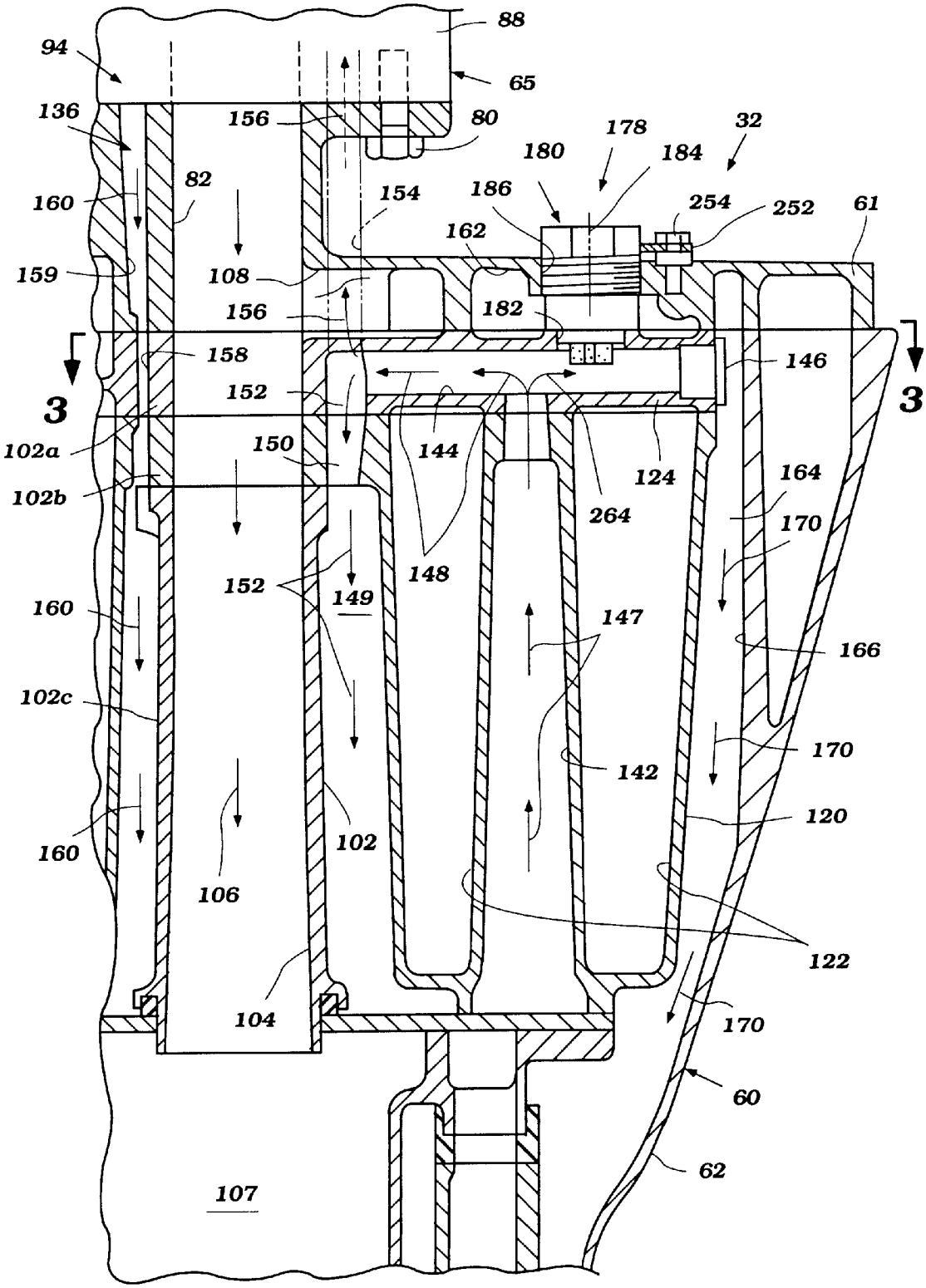
FIG. 2 is a sectioned side elevation view of a portion of a housing unit of the outboard motor.
Figure 3:
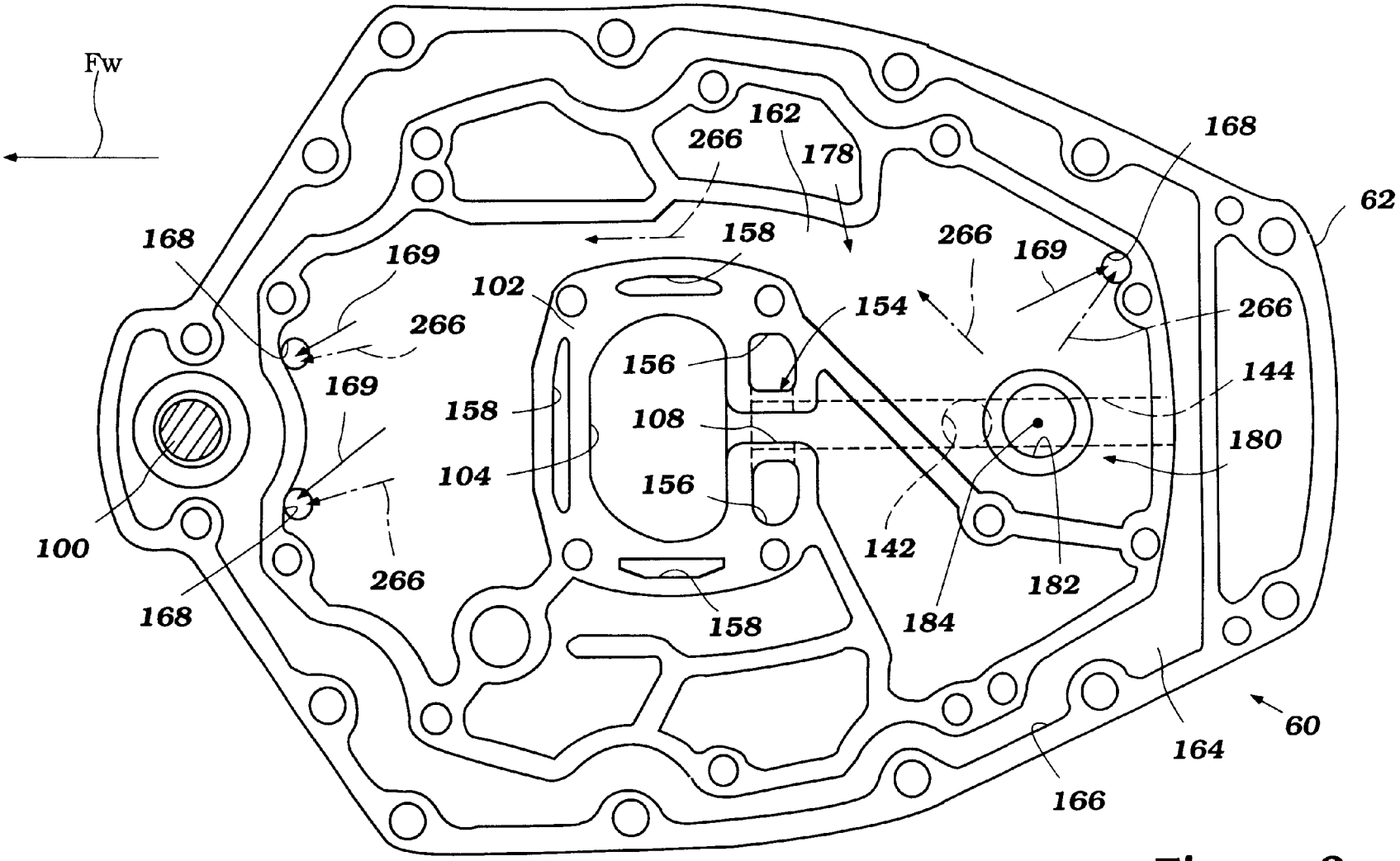
FIG. 3 is a top plan view of a portion of the housing unit member taken along the line 3—3 of FIG. 2.

With reference to FIGS. 1–3, an overall construction of an outboard motor 30 that employs a water cooling system 32 configured in accordance with certain features, aspects and advantages of the present invention will be described. The water cooling system 32 has particular utility in the context of a marine drive, such as the outboard motor 30, for instance, and thus is described in the context of an outboard motor 30. The cooling system, however, can be used with other types of marine drives (i.e., inboard motors, inboard/outboard motors, etc.) and also certain engines other than those adapted for use in marine drives.

In the illustrated arrangement, the outboard motor 30 generally comprises a drive unit 34 and a bracket assembly 36. The bracket assembly 36 supports the drive unit 34 on a transom 38 of an associated watercraft 40 and places a marine propulsion device in a submerged position with the watercraft 40 resting relative to a surface 42 of a body of water 43. The bracket assembly 36 preferably comprises a swivel bracket 44, a clamping bracket 46, a steering shaft 48 and a pivot pin 50.

The steering shaft 48 typically extends through the swivel bracket 44 and is affixed to the drive unit 34 by top and bottom mount assemblies 52. The steering shaft 48 is pivotally journaled for steering movement about a generally vertically extending steering axis defined within the swivel bracket 44. The clamping bracket 46 comprises a pair of bracket arms that preferably are laterally spaced apart from each other and that are attached to the watercraft transom 38.

The pivot pin 50 completes a hinge coupling between the swivel bracket 44 and the clamping bracket 46. The pivot pin 50 preferably extends through the bracket arms so that the clamping bracket 46 supports the swivel bracket 44 for pivotal movement about a generally horizontally extending tilt axis defined by the pivot pin 50. The drive unit 34 thus can be tilted or trimmed about the pivot pin 50.

As used through this description, the terms "forward," "forwardly" and "front" mean at or to the side of the outboard motor 30 where the bracket assembly 36 is located, unless indicated otherwise or otherwise readily apparent from the context use. The arrows Fw of FIGS. 1 and 3 indicate the forward direction. The terms "rear," "reverse," "backwardly" and "rearwardly" mean at or to the opposite side of the front side.

A hydraulic tilt and trim adjustment device 56 preferably is provided between the swivel bracket 44 and the clamping bracket 46 for tilt movement (raising or lowering) of the swivel bracket 44 and the drive unit 34 relative to the clamping bracket 46. Otherwise, the outboard motor 30 can have a manually operated device for tilting the drive unit 34. Typically, the term "tilt movement", when used in a broad sense, comprises both a tilt movement and a trim adjustment movement.

The illustrated drive unit 34 comprises a power head 58 and a housing unit 60, which includes an exhaust guide member 61, a driveshaft housing 62 and a lower unit 64. The power head 58 is disposed above the housing unit 60 and includes an internal combustion engine 65 that is positioned within a protective cowling assembly 66, which preferably is made of plastic. In most arrangements, the protective cowling assembly 66 defines a generally closed cavity 68 in which the engine 65 is disposed. The engine 65, thus, is generally protected within the enclosure defined by the cowling assembly 66 from environmental elements, such as rain, mist, water spray and sea salt, for instance.

The protective cowling assembly 66 preferably comprises a top cowling member 70 and a bottom cowling member 72. The top cowling member 70 preferably is detachably affixed to the bottom cowling member 72 by a coupling mechanism so that a user, operator, mechanic or repairperson can access the engine 65 for maintenance or for other purposes.

The top cowling member 70 preferably has an intake opening 76 defined through an upper rear portion. The ambient air is drawn into the closed cavity 68 via the intake opening 76. Typically, the top cowling member 70 tapers in girth toward its top surface, which is in the general proximity of the air intake opening 76. The taper helps to reduce the lateral dimension of the outboard motor 30, which helps to reduce the air drag on the watercraft 40 during movement.

The bottom cowling member 72 preferably has an opening through which an upper portion of the exhaust guide member 61 extends. The exhaust guide member 61 defines a top portion of the housing unit 60 and preferably is affixed atop the driveshaft housing 62. The exhaust guide member 61 preferably is made of aluminum alloy. The bottom cowling member 72 and the exhaust guide member 61 together generally form a tray. The engine 65 is placed onto this tray and can be affixed to the exhaust guide member 61 by bolts 80 (see FIG. 2). The exhaust guide member 61 also defines an exhaust discharge passage 82 through which burnt charges (e.g., exhaust gases) from the engine 65 pass.

The engine 65 in the illustrated embodiment operates on a four-cycle combustion principle. The engine 65 can have any suitable four-cycle engine construction. For example, the engine 65 includes a cylinder block defining four cylinder bores in which pistons reciprocate. The cylinder bores extend generally horizontally and are spaced apart vertically from each other.

As used in this description, the term "horizontally" means that the subject portions, members or components extend generally parallel to the water surface 42 (i.e., generally normal to the direction of gravity) when the associated watercraft 40 is substantially stationary with respect to the water surface 42 and when the drive unit 34 is not tilted (i.e., is placed in the position shown in FIG. 1). The term "vertically" in turn means that portions, members or components extend generally normal to those that extend horizontally.

At least one cylinder head member is affixed to a rear end of the cylinder block to close respective rear ends of the cylinder bores. The cylinder head member defines combustion chambers in combination with the cylinder bores and the pistons. A crankcase member also is affixed to a forward end of the cylinder block to close the respective forward ends of the cylinder bores and to define a crankcase chamber with the cylinder block. A crankshaft 84 extends generally vertically along a shaft axis 86 and is journaled for rotation on bearings within the crankcase chamber and is rotatably connected to the pistons through connecting rods. The cylinder block, the cylinder head and the crankcase member preferably are made of aluminum alloy and together define an engine body 88.

The illustrated engine, however, merely exemplifies one type of engine. Other types of engines having other number of cylinders, other cylinder arrangements and operating on other combustion principles (e.g., two-cycle or rotary) also may benefit from certain features, aspects and advantages of the present invention.

The engine 65 primarily comprises an air induction system 92, a fuel supply system, an ignition system and an exhaust system 94, although other systems also can be provided. The air induction system 92 is arranged to draw the air from the substantially closed cavity 68 toward the combustion chambers. Throttle valves preferably are provided in the induction system 92 to regulate the air flow (i.e., measure an amount of the air delivered) to the combustion chambers.

The fuel supply system is arranged to supply fuel to the combustion chambers. A port injected or indirect fuel injection device preferably is employed to spray the fuel into intake ports defined in the cylinder head member under control of a control device such as, for example, an ECU (Electronic Control Unit). Preferably, the initiation and duration of the injection cycles are controlled by the ECU. A direct fuel injection system that sprays fuel directly into the combustion chambers also can be used. Moreover, other fuel charge forming devices such as, for example, a carburetor assembly can be used instead of the fuel injection system.

The ignition system is arranged to fire air/fuel charges in the combustion chambers at controlled ignition timings. The ECU preferably controls the ignition timings also. Any suitable ignition system can be used.

The exhaust system 94 is arranged to route exhaust gases from the combustion chambers to a location outside of the outboard motor 30. In the illustrated embodiment, the cylinder block defines an exhaust manifold that collects exhaust gases. The exhaust gases pass from the manifold to the exhaust discharge passage 82 defined within the exhaust guide member 61.

The driveshaft housing 62 is positioned below the exhaust guide member 61 and journals a driveshaft 100 for rotation. The driveshaft 100 extends generally vertically through the driveshaft housing 62 and is coupled with the crankshaft 84 to be driven thereby.

The driveshaft housing 62 preferably defines an internal section of the exhaust system 94 that leads the majority of exhaust gases from the exhaust guide member 61 to the lower unit 64. An exhaust conduit 102 preferably depends from the exhaust guide member 61 to form an exhaust passage 104 communicating with the exhaust discharge passage 82 of the exhaust guide member 61. In the illustrated embodiment, the exhaust conduit 102 comprises three pieces, 102*a*, 102*b*, 102*c* that a generally aligned from top to bottom. The top, middle and bottom pieces 102*a*, 102*b*, 102*c* preferably are affixed to the exhaust guide member 61 by bolts directly or indirectly. The exhaust gases that flow through the exhaust discharge passage 82 and the exhaust passage 104 are indicated by the arrows 106 of FIG. 2. An expansion chamber 107 also is formed below the exhaust conduit 102 within the driveshaft housing 62. The exhaust gases flow into this expansion chamber 107 from the exhaust conduit 102 and abruptly expand therein. As a result, the exhaust gases lose energy and hence exhaust noise can be reduced.

In the illustrated embodiment, an idle exhaust passage 108 (FIG. 2) is branched off from the exhaust discharge passage 82 within the exhaust guide member 61. The idle passage 108 is coupled with an idle discharge passage which is defined within the driveshaft housing 62. An idle discharge port coupled with the idle discharge passage preferably is formed on a rear surface of the driveshaft housing 62 to discharge idle exhaust gases directly out to the atmosphere when the engine 65 is being operated at or about idle speed.

The lower unit 64 depends from the driveshaft housing 62 and supports a propulsion shaft 112 that is driven by the driveshaft 100. The propulsion shaft 112 extends generally horizontally through the lower unit 64 and is journaled for rotation. A propulsion device is attached to the propulsion shaft 112. In the illustrated arrangement, the propulsion device is a propeller 114 that is affixed to an outer end of the propulsion shaft 112. The propulsion device, however, can take the form of a dual counter-rotating system, a hydrodynamic jet, or any of a number of other suitable propulsion devices.

A transmission 116 preferably is provided between the driveshaft 100 and the propulsion shaft 112, which lie generally normal to each other (i.e., at a 90° shaft angle) to couple together the two shafts 100, 112 by bevel gears. The outboard motor 30 has a clutch mechanism that allows the transmission 116 to change the rotational direction of the propeller 114 among forward, neutral or reverse.

The lower unit 64 also defines an internal section of the exhaust system 94 that is connected with the internal exhaust section of the driveshaft housing 62, i.e., the expansion chamber 107. At engine speeds above idle, the majority of the exhaust gases are discharged toward the body of water 43 surrounding the outboard motor 30 through the internal sections and then a discharge section defined within the hub of the propeller 114. At the idle speed of the engine 65, the exhaust gases are primarily discharged through the idle discharge passages and the idle port because the exhaust pressure under this condition is smaller than the back pressure created by the body of water 43. Incidentally, the exhaust system 94 can include a catalytic device at any location in the exhaust system to purify the exhaust gases.

The outboard motor 30 preferably employs an engine lubrication system. Although any type of lubrication systems can be applied, a closed-loop type of system is used in the illustrated embodiment. The lubrication system comprises a lubricant oil reservoir 120 defining a reservoir cavity 122 preferably positioned behind the exhaust conduit 102 within the driveshaft housing 62. The illustrated oil reservoir 120 is formed together with the middle piece 102*b* of the exhaust conduit 102. A top portion of the oil reservoir 120 is covered with a housing member 124 that preferably is formed with the top piece 102*a* of the exhaust conduit 102. An oil pump is provided at a desired location, such as a lowermost portion of the camshaft 84, to pressurize the lubricant oil in the reservoir 120 and to pass the lubricant oil through a suction pipe toward engine portions, which are desirably lubricated, through lubricant delivery passages. The engine portions that are lubricated in this manner can include, for instance, the crankshaft bearings, the connecting rods and the pistons. Lubricant return passages also are provided to return the oil to the lubricant reservoir 120 for re-circulation. Preferably, the lubrication system further comprises a filter assembly to remove foreign matter (e.g., metal shavings, dirt, dust and water) from the lubricant oil before the oil is recirculated or is delivered to the various engine portions.

With reference still to FIGS. 1–3, the water cooling system 32 will now be described. As discussed above, the engine 65 generates heat when operated and this heat should be removed to reduce the likelihood of overheating. The exhaust system 94 including the exhaust conduit 102 also has heat because the exhaust gases hold much heat themselves. In addition, due to the return oil that has flowed through the heated engine 65, the oil reservoir 120 also can accumulate heat therein. In order to remove at least the heat in the engine 65, the exhaust system 94 and the oil reservoir 120, the outboard motor 30 employs the water cooling system 32.

As schematically shown in FIG. 1, the water cooling system 32 preferably is an open-loop type of system that introduces cooling water from the body of water 43 and then discharges the water to the body of water 43 after the water has traveled around the system 32. A water inlet port 126 is formed in the lower unit 64 to locate under the water surface 42 with the drive unit 34 being tilted down. A water supply line 128 connects the water inlet port 126 with water jackets 130 that extend within the engine body 88. The system 32 employs a water pump 132 preferably driven by the crankshaft to pressurize the water taken through the inlet port 126 toward the waterjackets 130. A water discharge line 136 connects the water jackets 130 with a water outlet port 138 formed also in the lower unit 64. The water supply and discharge lines 128, 136 primarily extend through the housing unit 60. The cooling water is supplied not only to the water jackets 130 but also to some portions of the exhaust system 94 such as the exhaust conduit 102 and further to the lubricant reservoir 120 en route to the water jackets 130 from the inlet port 126 or to the outlet port 138 from the waterjackets 130.

With reference to FIGS. 2 and 3, the water supply line 128 preferably includes a vertical water supply passage 142 defined generally vertically in the center of the oil reservoir 120 from bottom to top. The housing member 124 in turn defines a horizontal water supply passage 144 extending generally horizontally above the oil reservoir 120 that communicates with the vertical passage 142. The passage 144 preferably extends along an axis generally parallel to the longitudinal centerline of the motor and more preferably extends along the centerline. Because the illustrated horizontal supply passage 144 is formed by a machining process, a plug 146 preferably closes a rear end of the passage 144.

The water provided to the vertical supply passage 142 ascends to the horizontal supply passage 144 as indicated by the arrows 147 of FIG. 2 and then proceeds through the horizontal passage 144 as indicated by the arrow 148. While passing through the passages 142, 144, the water absorbs some of the heat that is accumulating within the oil reservoir 120. Preferably, a space 149 is formed around the exhaust conduit 102 and between the exhaust conduit 102 and the oil reservoir 120.

In the illustrated embodiment, a portion of the water in the horizontal passage 144 can be delivered to the space 149 through a narrow opening that communicates a delivery path 150 defined within the housing member 124, i.e., the top piece 102*a* and the middle piece 102*b*, as indicated by the arrows 152 to cool the exhaust conduit 102 and the oil reservoir 120.

The horizontal supply passage 144 primarily communicates with the water jackets 130 within the engine body 88 through a delivery passage 154. Although schematically shown in phantom line in FIG. 2, the delivery passage 154 preferably extends through the exhaust guide member 61 to the engine body 88. As seen in FIG. 3, the delivery passage 154 can be split to form a pair of paths 156 in the housing member 124. The pair of paths extend along both sides of the idle passage 108 in the exhaust guide member 61. In some arrangements, the delivery passage 154 can extend externally of the exhaust guide member 61, such as through a tube or a pipe. The majority of the water from the horizontal supply passage 144 thus ascends to the water jackets 130 through the delivery passage 154 as indicated by the arrows 156.

As shown in the center of FIG. 3, the water discharge line 136 preferably includes three paths 158 disposed around the exhaust conduit 102 in the top piece 102*a*. The paths 158 communicate with the water jackets 130 through a discharge passage 159 formed in the exhaust guide member 61 (see FIG. 2). In some constructions, the paths 158 also can communicate with the space 149. The water that has cooled the engine body 88 descends to the space 149 through the discharge passage 159 and the paths 158 preferably under the force of gravity, as indicated by the arrows 160. The water in the space 149 then is drained toward the outlet port 138 through a suitable drain port (not shown).

The discharge line 136 also includes a horizontal water discharge passage or area 162 (see FIG. 2) that extends in the exhaust guide member 61 generally horizontally and in parallel to the horizontal supply passage 144. As seen in FIG. 3, the discharge passage 162 preferably expands within the exhaust guide member 61. In the illustrated arrangement, the horizontal discharge passage 162 extends above the horizontal supply passage 144 to be located closer to the top end of the housing unit 60 than the horizontal supply passage 144. In some arrangements, however, the locations of the horizontal supply and discharge passages 144, 162 are interchangeable so that the horizontal supply passage 144 is located atop of the housing unit 60 rather than the horizontal discharge passage 162. Moreover, the supply and discharge passages 144, 162 can be disposed generally vertically on a vertical surface of the housing unit 60. Other suitable constructions also can be used.

The discharge line 136 further includes a generally vertical water discharge passage or area 164 defined between an inner surface 166 of a housing shell of the driveshaft housing 62 and the internal section of the exhaust system 94 and the oil reservoir 120. As seen in FIG. 3, the horizontal and vertical discharge passages 162, 164 communicate with each other through a number of spaced apertures 168 so that the water in the horizontal discharge passage 162 can move to the vertical discharge passage 164 as indicated by the arrows 169 of FIG. 3. Preferably, the lower surfaces defining the horizontal passage 162 are gently sloped toward the apertures 168 to facilitate drainage. Additionally, at least one aperture 168 preferably is positioned to enable drainage when the motor is tilted up to a storage position. The vertical discharge passage 164 communicates with the water outlet port 138 that is preferably formed at a bottom thereof. The water that has moved to the vertical discharge passage 162 falls down to the bottom as indicated by the arrows 170 of FIG. 2 and then is discharged to the body of water 43 through the outlet port 138.

The water cooling system 32 preferably has control valves. One of the control valves can be a temperature control valve that can adjust the temperature of the cooling water. The temperature control valve allows the water to go to the water jackets 130 if the water temperature is greater than a preset temperature but inhibits the water from being supplied to the water jackets 130 if the water temperature is less than the preset temperature. This advantageously increases the rate of engine warm up under a cold starting condition. The temperature control valve preferably is a thermostat, although other suitable devices can be used.

Another control valve preferably is a pressure control or relief valve that can relieve the water pressure within the supply line 128 if the pressure is greater than a preset pressure. The pressure control valve is particularly advantageous in use with the temperature control valve because the possible stoppage of the water flow by the temperature control valve might cause an increase in the water pressure in the supply line 128. This pressure control valve, thus, allows flow from the inlet side to the outlet side without requiring flow through the engine. Additionally, it should be noted that the pressure control valve can be used in applications not using a temperature control valve. Such applications might benefit from reduced cooling system damage on the supply side if a waterline upstream of the pressure control valve becomes plugged, for instance.

Figure 4:
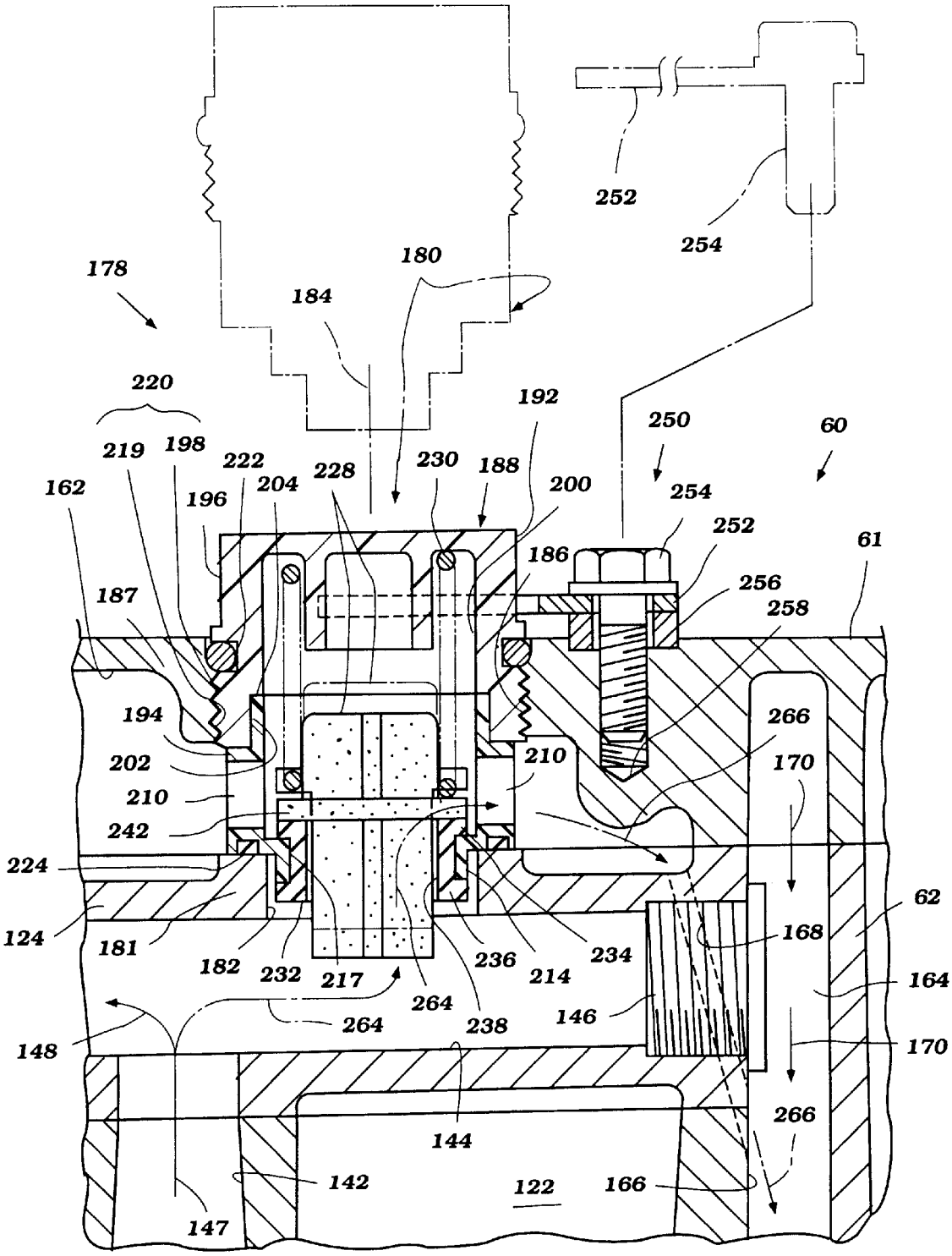
FIG. 4 is an enlarged sectioned side elevation view of a portion of the housing unit that illustrates an exemplary pressure relief construction configured in accordance with certain features, aspect and advantages of the present invention.
Figure 5:
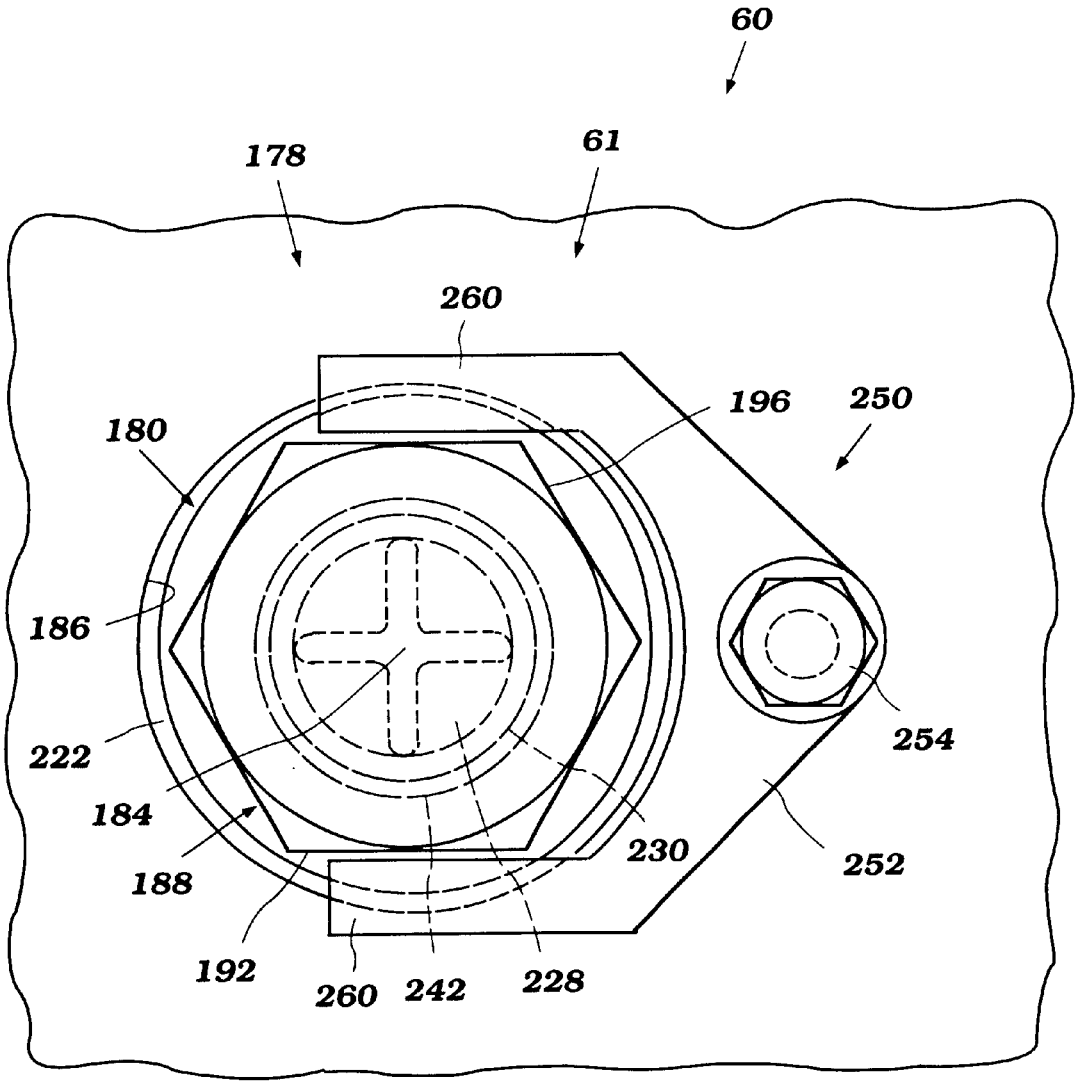
FIG. 5 is an enlarged top plan view of a portion of the housing unit that further illustrates the exemplary pressure relief construction of FIG. 4.

With reference still to FIGS. 2 and 3 and additionally with reference to FIGS. 4 and 5, an exemplary pressure relief construction 178 is illustrated that includes a pressure control valve unit 180 arranged and configured in accordance with certain features, aspects and advantages of the present invention.

The housing member 124 preferably has a wall portion 181 formed as a generally circular boss to define a lower opening 182 through which the horizontal supply passage 144 communicates with the horizontal discharge passage 162. The lower opening 182 preferably is formed in a circle and has an axis 184 that is generally normal to the supply and discharge passages 144, 162. Other suitable constructions and configurations of openings also can be used.

The exhaust guide member 61 in turn preferably defines an upper opening 186 through which the horizontal discharge passage 162 communicates with a location out of the housing unit 60. The upper opening 186 advantageously is formed at a wall portion 187 that defines a portion of an external surface of the exhaust guide member 61 and extends inwardly along the axis 184. Such a location eases access to the pressure relief construction for maintenance, repair and the like. The upper opening 186 preferably is circularly formed, similar to the opening 182. An axis of this upper opening 186 desirably is aligned with the axis 184. As will be more clearly understood later on, the axis 184 also preferably is aligned with an axis of the pressure control valve unit 180. As used through this description, therefore, the reference numeral 184 has been used to indicate the aligned axes of the lower and upper openings 182, 186 and the pressure control valve unit 180.

The control valve unit 180 comprises a valve casing 188 that extends through both of the openings 182, 186. The valve casing 188 preferably comprises a closure member 192 and a path member 194, both of which preferably are made of plastic, such as, for example, a nylon resin.

The illustrated closure member 192 advantageously can be generally configured as a bolt having a hexagonal bolt head 196 and a threaded portion, i.e., male screw portion 198. The illustrated closure member 192 generally has a cylindrical shape and defines a recessed portion 200 inside thereof. The closure member 192 also preferably defines a step portion 202 in the middle of the recessed portion 200. The step portion 202 can be cylindrical in shape and, when mounted, can be centered about the axis 184.

The path member 194 in turn preferably has an upper rim portion 204 extending along the axis 184. The upper rim portion 204 can be fitted into the step portion 202 so that the path member 194 is generally coupled with the closure member 192. Preferably, both of the members 192, 194 are welded together afterwards. Other constructions also can be used.

The path member 194 defines outlet openings 210 through which water in the unit 180 can move out to the discharge passage 162. The path member 194 also defines a lower rim portion 214 that is disposed generally opposite the upper rim portion 204. The lower rim portion 214 forms an inlet aperture 217 through which the water in the supply passage 144 can move into the unit 180. A water path 218, which includes the outlet openings 210 and the inlet aperture 217, thus is formed to connect the supply passage 144 and the discharge passage 162. An outer diameter of the lower rim portion 214 preferably is smaller than an inner diameter of the lower opening 182 and also preferably is smaller than an inner diameter of the upper rim portion 204.

The upper opening 186 preferably is formed as a female screw portion 219 such that a screw connection 220 is formed when combined with the male screw portion 198 of the closure member 192. In other words, the closure member 192 preferably is affixed to the upper opening 186 through this screw connection 220. Of course, press fitting or other suitable connecting techniques can be used. When mounted in position, the closure member 192 closes the upper opening 186 and the bolt head 196 protrudes from the exhaust guide member 61.

A seal member 222 such as, for example, an O-ring, advantageously is interposed between the closure member 192 and the wall portion 187 of the exhaust guide member 61 to water-tightly seal up the screw connection 220. With the closure member 192 affixed to the exhaust guide member 61, the outlet openings 210 of the path member 194 are positioned in the discharge passage 162 and the lower rim portion 214 is positioned in the lower opening 182.

It should be noted that the screw connection 220 does not allow one to accurately determine the relative position of the outlet openings 210 with respect to direction. In other words, the outlet openings 210 are placed in an unknown position in most applications. Of course, markings could be placed on the closure member 192 to help orient the openings 210. Nevertheless, such orientation confusion does not pose an issue in the illustrated arrangement because the pressure control valve unit 180 is surrounded by the water of the discharge passage 162 in all directions.

Another seal member 224 such as, for example, an O-ring, preferably is interposed between the path member 194 and the wall portion 181 of the housing member 124 form a generally water-tightly seal between these components such that the horizontal supply passage 144 only communicates with the horizontal discharge passage 162 through the inlet aperture 217 and the outlet openings 210.

The pressure control valve unit 180 also comprises a valve member 228, a bias component 230, such as a spring, for instance, and a valve seat member 232.

The valve seat member 232 preferably is made of an elastic material such as, for example, a rubber material, and preferably is generally cylindrically configured along the axis 184. The valve seat member 232 has upper and lower flanges 234, 236 at respective top and bottom ends. The valve seat member 232 is attached to the path member 194 with the upper and lower flanges 234, 236 mounted onto the lower rim portion 214. An inner surface of the valve seat member 232 thus defines an inlet opening or valve opening 238 that substantially connects the supply passage 144 with the outlet openings 210 and further with the discharge passage 162. A top portion of the valve seat member 232 preferably is shaped flat to define a valve seat extending generally normal to the axis 184.

The valve member 228 preferably is made of plastic such as, for example, a vinyl resin, and preferably is generally configured as a cross shape in a plan view section. A circular flange 242 extends around the valve member 228 and normal to the axis 184 generally in the middle of the valve member 228. The valve member 228 thus can seat on the upper end of the illustrated valve seat of the valve seat member 232. The valve member 228 is movable generally along the axis 184.

The bias member 230 extends generally vertically along the axis 184 to be retained between a top inner surface of the closure member 192 and a top surface of the flange 242 of the valve member 228. The bias member 230 preferably is made of metal material, more preferably, stainless steel or another material that is tolerant or durable against corrosion. In the illustrated arrangement, a coil spring is used as the bias member 230. Preferably, a cylindrically shaped rib portion 244 extends downwardly inside of the closure member 192. The rib portion 244, together with an upper portion of the valve member 228 above the flange 242, acts as a guide for the spring 230. The bias spring 230 urges the valve member 228 downwardly toward the valve seat member 232 to close the inlet opening 238, i.e., to disconnect the passages 144, 162 from each other. This is a closed position of the valve member 228.

If a water pressure in the supply passage 144 becomes large enough to overcome the bias force of the spring 230, the water in the supply passage 144 lifts up the valve member 228 to an open position shown in phantom line to open the inlet opening 238. In other words, the pressure control valve unit 180 permits the water in the supply passage 144 to move to the discharge passage 162 when the pressure of the supply passage 144 is greater than a preset pressure. The preset pressure can vary with changes of the spring constant, i.e., setting of the spring 230 such as, for example, the thickness and quality of the material and the number of winding turns.

In the illustrated arrangement, the members 228, 230, 232 are previously set with the valve casing 188 before the closure and path members 192, 194 are coupled together. That is, the valve seat member 232 is affixed to the path member 194 at first and then the valve member 228 and the coil spring 230 are placed above the valve seat member 232 in this order. Then, the closure member 192 is welded with the path member 194 to hold the valve member 228 and the spring 230 therein. The pressure control valve unit 180 thus can be a totally assembled component. As an assembled component, the illustrated pressure control valve unit 180 can be positioned above its mounting location and then can be screwed into the upper openings 186 until the bottom of the path member 194, more specifically, the bottom of the portions that define the outlet openings 210, reaches the top of the housing member 124, i.e., the wall portion 181.

In order to prevent the closure member 192 from turning, i.e., to prevent the screw connection 220 from loosening, a locking mechanism 250 preferably is provided. The locking mechanism 250 preferably comprises a fork member 252, a bolt 254, a spacer 256 and a bolt hole 258 formed in the exhaust guide member 61. The bolt hole 258 can positioned adjacent to the pressure control valve unit 180 such as on a rear side relative to the unit 180. The spacer 256 has a through-hole and is fitted into a shallow guide hole defined around the bolt hole 258. An inner diameter of the through-hole is slightly larger than an outer diameter of the bolt 254. The fork member 252 has also a through-hole that has an inner diameter which is generally equal to the inner diameter of the through-hole of the spacer 256, and a pair of holder sections 260 split from the through hole. The length between the holder sections 260 can be slightly longer than the length between opposite sides of the hexagonal bolt head 196. The fork member 252 is disposed on the spacer 258 with the bolt head 196 interposed between the holder sections 260. The bolt 254 then is affixed to the bolt hole 258 to hold the fork member 252 in this position. The closure member 192 thus is fixed also in the present position.

Normally, the water introduced into the water cooling system 32 goes to the water jackets 130 in the engine block 88 or to the space 149 around the exhaust conduit 102 and the oil reservoir 120 through the horizontal water supply passage 144. Under the circumstances, the valve member 228 is seated on the valve seat member 232 by the biasing force of the spring 230 to close the inlet opening 238. If the water pressure in the supply passage 144 becomes abnormally high, the pressure control valve unit 180 can be activated by the water pressure lifting the valve member 228 against the biasing force of the spring 230. The supply passage 144 thus communicates with discharge passage 194 through the water path 218 and the water in the supply passage 144 moves to the discharge passage 162 as indicated by the arrows 264 of FIGS. 3 and 4. The water that has entered the discharge passage 162 further moves to the apertures 168 and flows out to the vertical water discharge passage 164 as indicated by the arrows 266 of FIGS. 3 and 4 together with the water from the water jackets 130 of the engine body 88. The water from the supply passage 144 is used to cool the internal section of the exhaust system 94 and the oil reservoir 120 accordingly. The water from the supply passage 144 is colder than the water from the water jackets 130, the exhaust system 94 and the oil reservoir 120 can be more effectively cooled in comparison with the situation using only the water from the water jackets 130.

Thus far described, in the illustrated embodiment, the water supply and discharge passages are formed close to each other and the pressure control valve unit is positioned in this arrangement. The pressure relief construction thus can be formed compact enough to suit for the housing unit of the outboard motor. More specifically, the supply and discharge passages are merely spaced apart from each other by the wall portion of the housing member. Thus, the valve unit extends through the relative thin surface wall to connect and disconnect both the passages. Thus, the valve unit can be compactly structured. In addition, the illustrated pressure control valve unit is formed as an discrete assembly and can be placed in position by simply being inserted into the openings that are defined atop of the housing unit. The pressure control valve unit thus can be easily installed and/or removed. Further, the pressure control valve unit in the illustrated embodiment is basically formed with plastic or rubber material except for the coil spring. The coil spring is a metal material but is durable against corrosion. This is advantageous because the unit can be effectively protected from corrosion or rusting even though seawater is used as the cooling water.

Of course, the foregoing description is that of a preferred construction having certain features, aspects and advantages in accordance with the present invention. For instance, the valve casing can be formed with a different number of members other than the closure and path members. The locking mechanism can be omitted in some applications or other suitable locking mechanisms can be used. Various other changes and modifications may be made to the above-described arrangements without departing from the spirit and scope of the invention, as defined by the appended claims.

What is claimed is:

1. A water cooling system for an internal combustion engine comprising a housing body defining a water supply passage and a water discharge passage, the supply passage being arranged to introduce water into the system from outside, the discharge passage being arranged to discharge the water to a location outside of the system, the supply and discharge passages extending close to each other at least at one location, the housing body further defining an opening through which the supply and discharge passages communicate with each other, and a pressure control valve unit disposed within the opening to connect or disconnect the supply passage with the discharge passage, the pressure control valve unit permitting the water in the supply passage to move to the discharge passage when a pressure of the supply passage is greater than a preset pressure.

2. The water cooling system as set forth in claim 1, wherein the housing body has a wall portion defining an external surface of the housing body, the supply or discharge passage extends adjacent to the wall portion, the wall portion defines a second opening, and the pressure control valve unit extends through the first and second openings.

3. The water cooling system as set forth in claim 2, wherein the pressure control valve unit comprises a first member disposed within the second opening for closing the second opening and a second member coupled with the first member, the second member defines a path connecting the supply and discharge passages with each other.

4. The water cooling system as set forth in claim 3, wherein the second member defines a valve opening positioned within the first opening, and the second member closes the first opening except for the valve opening.

5. The water cooling system as set forth in claim 4, wherein the pressure control valve unit further comprises a valve member moveable between an open position where the valve opening is opened and a closed position where the valve opening is closed, and a bias mechanism to urge the valve member toward the closed position.

6. The water cooling system as set forth in claim 5, wherein the bias mechanism includes a spring retained between the first member and the valve member.

7. The water cooling system as set forth in claim 2, wherein the wall portion and the first member together form a coupling mechanism to couple the first member with the housing body.

8. The water cooling system as set forth in claim 7, wherein the wall portion defines a female screw at the second opening, and the first member defines a male screw to connect with the female screw.

9. The water cooling system as set forth in claim 7 additionally comprising a holding mechanism to hold the first member under the coupled condition with the housing body.

10. The water cooling system as set forth in claim 3, wherein the first and second members are unitarily affixed with each other as an indiscrete assembly.

11. The water cooling system as set forth in claim 3, wherein the first and second members are made of plastic.

12. The water cooling system as set forth in claim 1, wherein the supply and discharge passages at least in part extend generally in parallel to each other, and the pressure control valve unit has an axis extending generally normal to the supply and discharge passages.

13. The water cooling system as set forth in claim 12, wherein the pressure control valve unit includes a valve member moveable along the axis.

14. The water cooling system as set forth in claim 1, wherein the pressure control valve unit defines a valve opening positioned within the opening, and the pressure control valve unit closes the opening except for the valve opening.

15. The water cooling system as set forth in claim 14, wherein the pressure control valve unit further comprises a valve member moveable between an open position where the valve opening is opened and a closed position where the valve opening is closed, and a bias mechanism to urge the valve member toward the closed position.

16. The water cooling system as set forth in claim 1, wherein the housing body does not define any substantial wall portions that surround the pressure control valve unit generally in the discharge passage, and the pressure control valve unit defines an outlet that opens toward the discharge passage.

17. An outboard motor comprising a housing unit adapted to be mounted on an associated watercraft, an internal combustion engine mounted on the housing unit, the housing unit defining a water delivery passage and a water discharge passage communicating with each other through a first opening, the water delivery passage being arranged to deliver cooling water to the engine, the water discharge passage being arranged to discharge the cooling water from the engine, the delivery passage or the discharge passage communicating with a location out of the housing unit through a second opening, and a pressure relief valve assembly extending through the first and second openings, the pressure relief valve assembly being arranged to allow the cooling water in the delivery passage to move to the discharge passage when a pressure of the delivery passage is greater than a preset pressure.

18. The outboard motor as set forth in claim 17, wherein the pressure relief valve assembly comprises a first member disposed within the second opening to close the second opening, and a second member coupled with the first member, and the second member defines a path connecting the delivery and discharge passages with each other.

19. The outboard motor as set forth in claim 18, wherein the housing unit and the first member together forms a coupling mechanism to couple the first member with the housing unit.

20. The outboard motor as set forth in claim 17, wherein the pressure relief valve assembly defines a valve opening positioned within the first opening, and the housing unit closes the first opening except for the valve opening.

21. The outboard motor as set forth in claim 20, wherein the pressure relief valve assembly further comprises a valve member moveable between an open position where the valve opening is opened and a closed position where the valve opening is closed, and a bias mechanism to urge the valve member toward the closed position.

22. The outboard motor as set forth in claim 17, wherein the delivery and discharge passages extend generally horizontally.

23. The outboard motor as set forth in claim 22, wherein the pressure relief valve assembly has an axis extending generally vertically.

24. The outboard motor as set forth in claim 23, wherein the pressure relief valve assembly includes a valve member moveable along the axis.

25. The outboard motor as set forth in claim 22, wherein the delivery or the discharge passage extends generally atop of the housing unit.

26. The outboard motor as set forth in claim 22, wherein the discharge passage extends generally atop of the housing unit.

27. The outboard motor as set forth in claim 17 additionally comprising at least one of an exhaust conduit and a lubricant reservoir formed within the housing unit for the engine, and the discharge passage extending adjacent to the exhaust conduit or the lubricant reservoir downstream of the pressure control valve assembly.

* * * * *